US012612833B2

(12) United States Patent
Morrison et al.

(10) Patent No.: US 12,612,833 B2
(45) Date of Patent: Apr. 28, 2026

(54) DIRECT-TO-GUN SETTING TOOL

(71) Applicant: DBK Industries, LLC, Crowley, TX (US)

(72) Inventors: Jeremy Todd Morrison, Pickton, TX (US); Nicholas Clayton Fearka, Mansfield, TX (US)

(73) Assignee: DBK INDUSTRIES, LLC, Crowley, TX (US)

( * ) Notice: Subject to any disclaimer, the term of this patent is extended or adjusted under 35 U.S.C. 154(b) by 222 days.

(21) Appl. No.: 18/392,290

(22) Filed: Dec. 21, 2023

(65) Prior Publication Data

US 2024/0209704 A1 Jun. 27, 2024

Related U.S. Application Data

(60) Provisional application No. 63/434,673, filed on Dec. 22, 2022.

(51) Int. Cl.
*E21B 23/06* (2006.01)

(52) U.S. Cl.
CPC ..... *E21B 23/065* (2013.01)

(58) Field of Classification Search
CPC .... E21B 23/065; E21B 23/06; E21B 23/0414; E21B 33/128; E21B 23/04
See application file for complete search history.

(56) References Cited

U.S. PATENT DOCUMENTS

| | | | | |
|---|---|---|---|---|
| 6,289,813 | B1 * | 9/2001 | Duguet | F42B 3/124 102/202.7 |
| 6,591,754 | B1 * | 7/2003 | Baur | H01R 13/665 102/206 |
| 9,581,422 | B2 * | 2/2017 | Preiss | E21B 43/1185 |
| 9,598,942 | B2 * | 3/2017 | Wells | E21B 43/1185 |
| 9,771,769 | B2 * | 9/2017 | Baker | E21B 23/0412 |
| 9,810,035 | B1 * | 11/2017 | Carr | E21B 23/065 |
| 10,689,931 | B2 * | 6/2020 | Mickey | E21B 23/065 |
| 12,139,984 | B2 * | 11/2024 | Morrison | E21B 17/042 |
| 2015/0345922 | A1 * | 12/2015 | Lanclos | F42B 3/125 102/335 |
| 2017/0268860 | A1 * | 9/2017 | Eitschberger | F42D 1/05 |
| 2018/0202248 | A1 * | 7/2018 | Harrington | E21B 33/12 |
| 2018/0299239 | A1 * | 10/2018 | Eitschberger | H05K 5/069 |
| 2019/0048693 | A1 * | 2/2019 | Henke | E21B 43/11855 |

(Continued)

FOREIGN PATENT DOCUMENTS

DE 4218881 C2 * 7/1994 ..... F42B 3/122

*Primary Examiner* — Daniel P Stephenson
(74) *Attorney, Agent, or Firm* — Johnston IP Law, PLLC

(57) ABSTRACT

In the context of downhole tools, fixed volume power charge initiator assemblies and bottom hole assemblies utilizing fixed volume power charge initiator assembly are disclosed. The fixed volume power charge initiator assembly has a pressure bulkhead coupled to a cartridge. The cartridge includes an igniter disposed within an interior cavity of the cartridge. When used in a bottom hole assembly the fixed volume power charge initiator assembly is located in a setting tool adjacent to a power charge located within a combustion chamber of the setting tool. The combustion chamber and the cartridge together define a fixed total combustion volume. In some instances, the fixed volume power charge initiator assembly includes a power charge detector switch. Other assemblies are discussed.

17 Claims, 12 Drawing Sheets

(56) References Cited

U.S. PATENT DOCUMENTS

| | | | | |
|---|---|---|---|---|
| 2019/0162057 | A1* | 5/2019 | Montoya Ashton | E21B 43/1185 |
| 2019/0257181 | A1* | 8/2019 | Langford | E21B 43/1185 |
| 2019/0292887 | A1* | 9/2019 | Austin, II | F42D 1/05 |
| 2020/0018132 | A1* | 1/2020 | Ham | E21B 33/1292 |
| 2020/0362652 | A1* | 11/2020 | Eitschberger | E21B 23/04 |
| 2021/0355773 | A1* | 11/2021 | Eitschberger | E21B 41/0085 |
| 2023/0193711 | A1* | 6/2023 | Eitschberger | E21B 41/00 |
| 2023/0332475 | A1* | 10/2023 | Morrison | E21B 43/261 |
| 2024/0200415 | A1* | 6/2024 | Eitschberger | E21B 23/04 |
| 2024/0209704 | A1* | 6/2024 | Morrison | E21B 23/065 |
| 2024/0218755 | A1* | 7/2024 | Morrison | E21B 36/04 |
| 2025/0059843 | A1* | 2/2025 | Morrison | E21B 43/11852 |

* cited by examiner

DIRECT-TO-GUN SETTING TOOL

CROSS-REFERENCE TO RELATED APPLICATION

This application claims the benefit of U.S. Provisional Application Ser. No. 63/434,673 filed on Dec. 22, 2022, entitled "Direct-To-Gun Setting Tool," which is incorporated herein by reference in its entirety for all purposes.

TECHNICAL FIELD

This application is directed, in general, to downhole oil tools, and more specifically, to downhole setting tools for setting frac plugs, bridge plugs, and packers for sealing well casings, and more particularly still, to direct-to-gun setting tools.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Oil and gas wells are drilled into earth formations by first creating a borehole and then running and cementing casing in the borehole. Well tools such as bridge plugs, packers, cement retainers, and frac plugs are often run into cased wells and set using setting tools powered by flammable power charges. Conventional well tools providing well casing sealing assemblies typically include a packer having one or more elastomeric sealing elements that are squeezed between a packer mandrel and the casing. They are held in place by one or more slip assemblies that are wedged between conical sleeves of the packers and the casing. The packers are configured for use as bridge plugs, tubing packers, cement retainers, and frac plugs. Improvements in the application of well casing sealing assemblies remain desirable along with the techniques and equipment for placing them.

SUMMARY

According to an illustrative embodiment, a gas-operated fixed-volume setting tool for use in oil wells includes a mandrel having a first end and a second end, a barrel piston having a first end and a second end, a pressure block disposed in the mandrel at the first end of the mandrel, a pressure bulkhead coupled to the pressure block and forming a seal therewith, a cartridge coupled to the pressure bulkhead, an igniter having a first end and a second end. The barrel piston extends over at least a portion of the mandrel when in an in-line configuration and is releasably coupled to the mandrel when in the in-line configuration. The mandrel includes an interior combustion chamber having a first end proximate to the first end of the mandrel and a second end proximate to the second end of the mandrel. The pressure block, the pressure bulkhead, and the cartridge form a seal to the combustion chamber to at least a first threshold pressure on the first end of the combustion chamber and thereby define a fixed combustion chamber volume. The cartridge includes a housing body having a first end and a second end, a cartridge mating portion formed on the first end of the housing body that mates with the pressure bulkhead, and an interior cavity formed within the housing body. The igniter is at least partially disposed within the interior cavity of the cartridge According to an illustrative embodiment, a fixed volume power charge initiator assembly for use as an aspect of a gas-power setting tool, the fixed volume power charge initiator includes a pressure bulkhead having a first end and a second end, a cartridge having a first end and a second end, and an igniter, having a first end and a second end. The pressure bulkhead is formed with a mating member. The cartridge includes a housing body having a first end and a second end, a cartridge mating portion formed on the first end of the housing body, and an interior cavity formed within the housing body. The mating member of the pressure bulkhead is sized and configured to mate with the cartridge mating portion of the cartridge. The pressure bulkhead is coupled to the cartridge. The igniter is coupled to the cartridge and at least partially disposed within the interior cavity of the cartridge.

According to an illustrative embodiment, a fixed volume power charge initiator assembly for use as an aspect of a gas-power setting tool, the fixed volume power charge initiator includes a pressure bulkhead having a first end and a second end, a cartridge having a first end and a second end, an igniter having a first end and a second end, a power charge detector switch at least partially disposed within the interior cavity of the cartridge, and a pressure block having a bore. The cartridge includes a housing body having a first end and a second end and an interior cavity formed within the housing body. The pressure bulkhead is coupled to first end of the cartridge and the pressure bulkhead is at least partially disposed within the interior cavity of the housing. The igniter is coupled to the cartridge and at least partially disposed within the interior cavity of the cartridge. An interior wall of the bore is sized and configured to mate with an exterior wall of the cartridge. The first end of the cartridge is disposed within the bore of the pressure block. When the power charge detector switch is not in an inactivated state, the components of the power charge detector switch do not make a grounded connection for an igniter electrical circuit. When the power charge detector switch is in an activated state, at least one component of the power charge detector switch makes a grounded connection for the igniter electrical circuit by contacting a grounded component. Other embodiments of setting tools and assemblies are disclosed herein.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims. Unless otherwise indicated, as used throughout this document, "or" does not require mutual exclusivity.

A fracking example is provided for context, but other applications may apply. In the fracking process, after a horizontal well is drilled and cased, perforating guns conveyed on wireline, coiled tubing, or stick pipe are fired in the horizontal section of the well. Once the perforated guns are fired and pulled out, the first stage is fractured. After that, it is desirable to isolate an upstream portion—above the previously perforated portion—and this is done by placing a frac plug. The frac plug with a setting tool is conveyed into the well as part of a bottom hole assembly (BHA) to the desired depth. On depth, the firing head is activated by an electrical current from a wireline truck that activates an igniter to then cause the power charge in a setting tool to activate. That in turn motivates movement of a barrel piston to do a full and complete stroke, which causes the setting tool to disconnect from the frac plug. In this process, the frac plug is sealed in the casing. The second zone is then treated and so forth until all the zones are perforated as desired.

Figure 1:
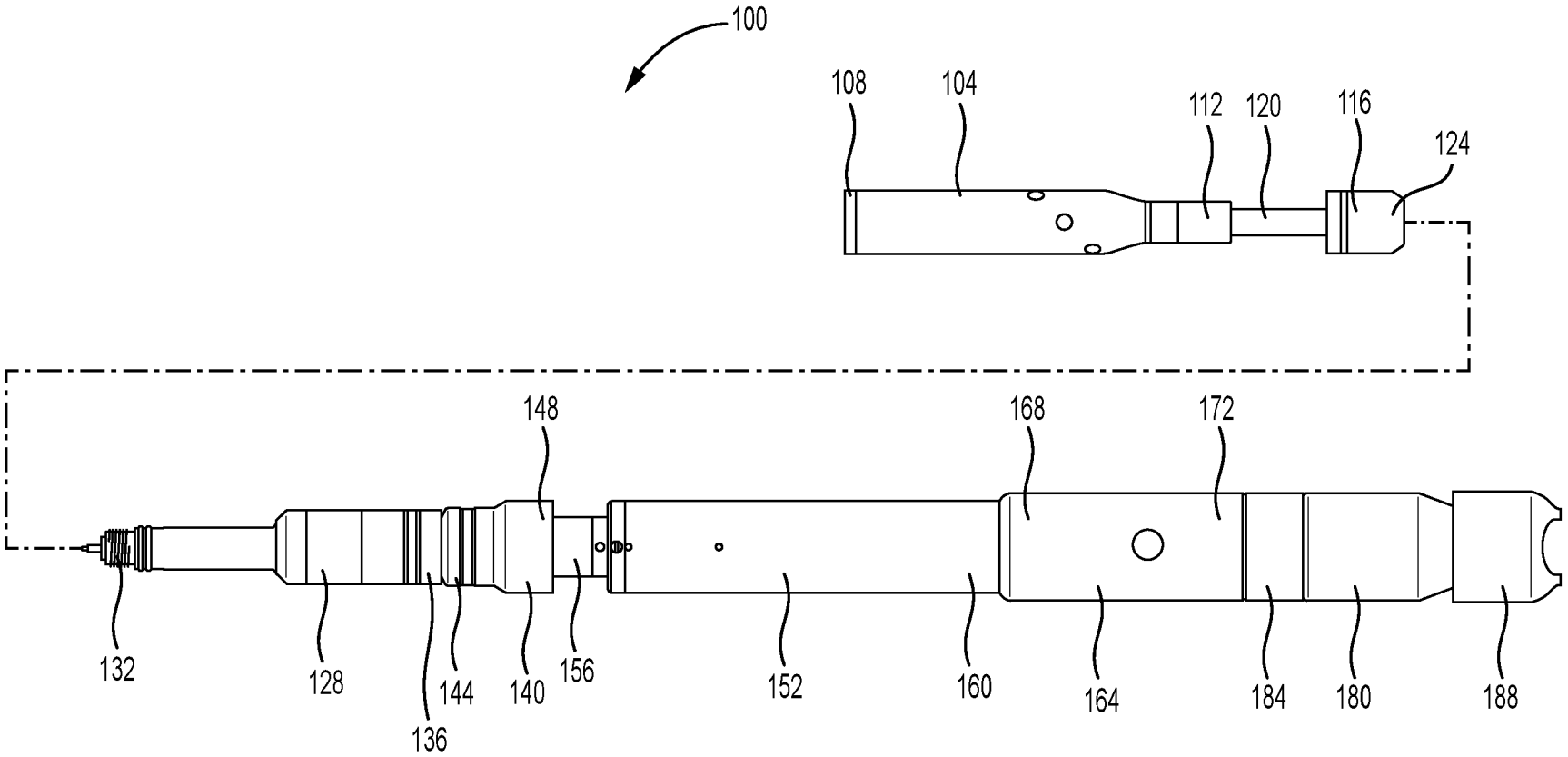
FIG. 1 is a schematic, elevation view of an illustrative embodiment of a bottom hole assembly including an illustrative embodiment of an enhanced setting tool.

Referring now primarily to FIG. 1, a bottom hole assembly (BHA) 100 is shown. The upper most component of the bottom hole assembly 100 as shown is a perforating gun 104 having an upper end 108 (or first end) and a lower end 112 (or second end). The perforating gun 104 is followed by an adapter 116 having an upper end 120 (or first end) and a lower end (or second end) 124. The upper end 120 of the adapter 116 couples with the lower end 112 of the perforating gun 104. A quick change 128 may follow next. The quick change 128 has an upper end 132 (or first end) and a lower end 136 (or second end). Coupled to the quick change 128 is a firing head 140, which has an upper end 144 (or first end) and a lower end 148 (or second end). Next, an illustrative embodiment of a setting tool 152, e.g., a gas-operated setting tool, follows. The setting tool 152 has an upper end 156 (or first end) and a lower end 160 (or second end). The setting tool 152 is coupled to a running gear 164 setting sleeve (an adapter resides inside the setting sleeve and cannot be explicitly seen; it connects the lower mandrel of the setting tool to the plug mandrel), which has an upper end 168 (or first end) and a lower end 172 (or second end). The running gear 164 is coupled to an illustrative plug 180, e.g., a fracking plug or bridge plug or other downhole plug. The plug 180 has an upper end 184 (or first end) and a lower end 188 (or second end).

In this embodiment, the firing head 140 is shown for comparison purposes and contrast coupled to the setting tool 152 to provide ignition thereto when desired. In contrast, the disclosure in one aspect contemplates removing the firing head 140, the quick change 128, and the adapter 116 and placing an igniter (400 in FIG. 6) in the setting tool 152 itself. Thus, in the present disclosure the setting tool may be referred to as a direct-to-gun setting tool 152, or a direct-to-gun, fixed-volume setting tool.

Continuing with the example of FIG. 1, the setting tool 152 is activated by ignition of a power charge disposed within a combustion chamber of the setting tool 152. The power charge is typically a mixture of components that, when mixed together, are explosive in nature. Ignition of the power charge and the resulting explosion results in the formation a relatively large amount of gas within the combustion chamber. Since the combustion chamber is sealed on the uphole side by the firing head 140, gas discharges in the downhole direction toward the downhole tool 152 being activated and, in the case of FIG. 1 positions the plug 180. The pressure and movement of the gases generated is used to activate mechanisms of the downhole tool being activated to cause the function of the downhole tool, which in the example of FIG. 1 is the setting of the plug 180. The ignition of the power charge within the setting tool 120 is initiated by an igniter located within the firing head 140.

With further reference to FIG. 1, the combination of the setting tool 152 and firing head 140 create an issue of not knowing the precise combustion volume in which the combustion gases will be generated. Knowing this combustion volume is important because it can be used to ensure that the power charge contains an appropriate amount of material to generate the correct amount of gas for the combustion volume for the gases to produce the desired results. If the amount of power charge is too large for the combustion volume, then an excessive amount of gas and therefore gas pressure may be generated. This may result in damage of the downhole components, leakage of seals between components, waste of power charge material, and the failure of the downhole tool being activated to properly activate. On the other hand, if the amount of power charge is too little compared to the combustion volume, then ignition of the power charge may result in too little gas being generated and gas pressures that are too low for the combustion chamber. This is equally undesirable because it can result in issues such as the failure to activate the downhole component being activated, waste of power charge material, and waste of time.

The uncertainty of the combustion volume of the BHA 100 of FIG. 1 results from the firing head 140 and the setting tool 152 being two separate components which are attached to each other, which is often done in the field. While prior to assembly the portion of the combustion volume that is formed from the setting tool 152 or that formed from the firing head 140 is individually known, the combined total combustion volume is unknown. The interior of the firing head 140 is fluidly coupled to the combustion chamber of the setting tool 152. This is necessary for the igniter, which is located within the firing head 140, to ignite the power charge, which is located within the setting tool 152. The power charge, however, is already preselected and sized to fit within the combustion chamber of the setting tool 152 prior to assembly. In addition, in embodiments that use a non-pressure sealing igniter, rather than a bulkhead igniter, any dead volume uphole of the igniter will also be included in the total combustion volume. The more components that are involved, e.g., adapters, quick changes, etc., the greater the total combustion volume will be and the lower the total pressure will be.

The amount of power charge, therefore, does not take into account the additional combustion volume that includes the volume located with the firing head 140. Or, this additional volume must be estimated at that time of choosing the correct size and amount of power charge to include within the setting tool 152. This may result in too little or too much power charge material, and therefore, too little, or too much gas generation, for the desired purpose and effect. This problem is further exacerbated by the fact that various setting tools 120 and various firing heads 140 may be mixed and matched in the field when the BHA 100 is assembled. Each possible setting tool 120 has its own unique combustion volume and amount of power charge, and each possible firing head 140 has its own unique volume that is included in the total combustion volume.

The possible combinations and resulting total combustion volumes make it difficult to ensure that the gas being generated is the correct amount of gas for any particular combination of firing head 140 and setting tool 152. In addition, it is not uncommon to need to include an adapter between the firing head 140 and the setting tool 152 to allow for proper attachment of these components. The need for an adapter, and the many possible adapters, only increase the uncertainty of the total combustion volume because each adapter may have its own internal volume that is included in the total combustion volume.

The variation in volume presents a challenge. The actual volume in the setting tool 152 like that in FIG. 1 is not often known; one does not know how much volume is being added to the effective combustion chamber by the addition of the components. At times this might mean the power charge in the interior combustion chamber of the setting tool 152 is less powerful than desired given the volume involved. Effective use of the setting tool 152 is dependent on sufficient internal gas pressure being created by the power charge. The amount of gas pressure that can be created is determined by the amount of volume that must be pressurized. While not limited to theory, this can be explained using Boyle's Gas Law.

Boyle's Gas Law states that the pressure (P) of a given quantity of gas varies inversely with its volume (V) at constant temperature: $P_1V_1=P_2V_2$. Now consider that a conventional setting tool is essentially an open container before components are added. The total volume of the setting tool in its final use condition is determined by the ancillary equipment or components that are connected directly to setting tool on the open side, such as the firing head 140. If this equipment has a large amount of internal volume, the power charge in the interior combustion chamber may not be able to generate sufficient pressure to successfully operate the setting tool 152, including disconnecting from the plug 180. In this situation, the issue is that the volume is a variable or unknown in the equation. The embodiments of enhanced setting tools below address this issue by establishing a set, or fixed, volume. A fixed volume may be established by forming a pressure block (304 in FIG. 4) and a fixed volume power charge initiator assembly 316 (FIG. 6) that go into an upper end 156 of the setting tool 152. In addition to having a fixed, known volume, it is desirable to have an igniter in the setting tool 152 downward from the pressure block 226.

Figure 2:
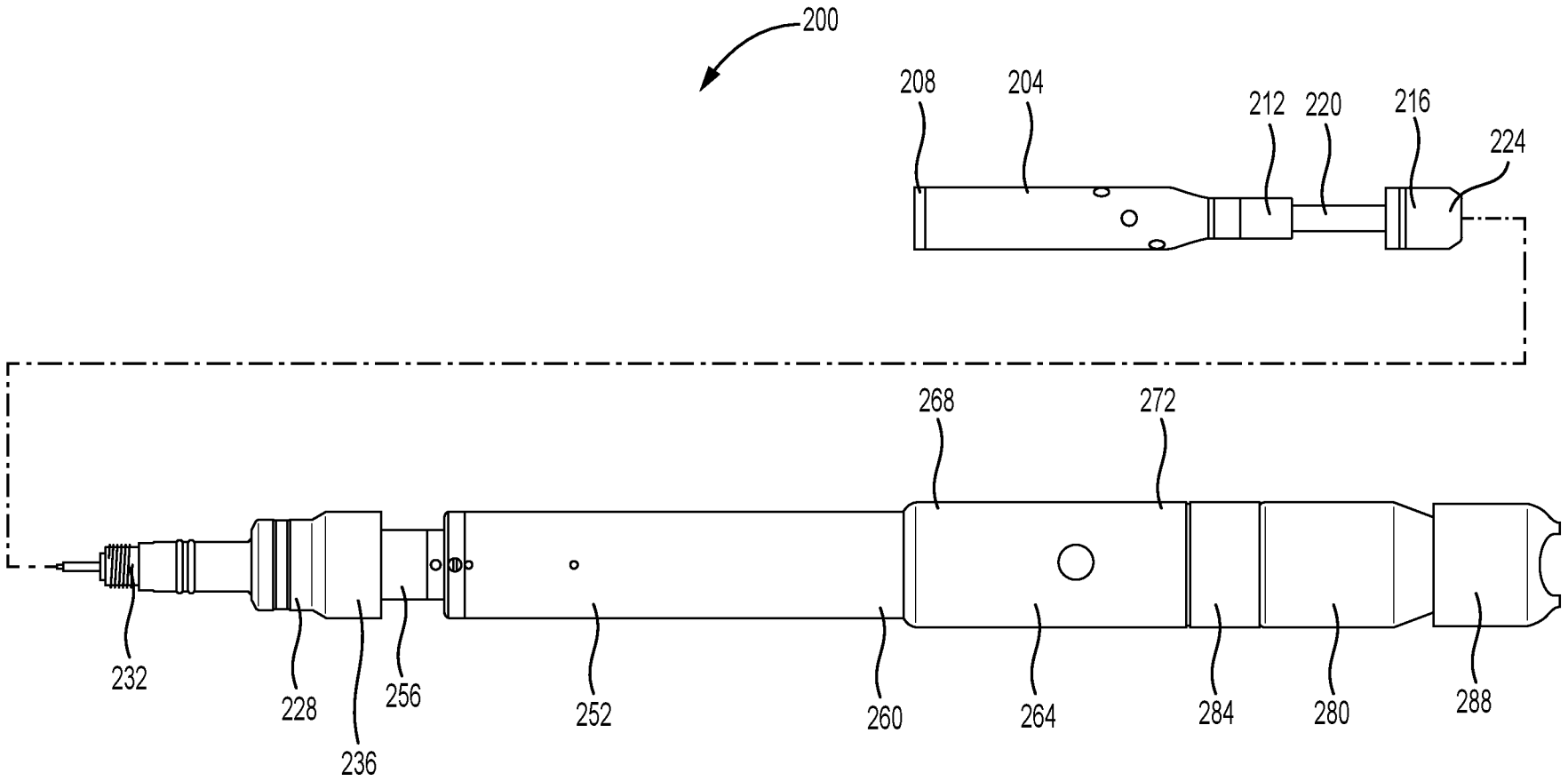
FIG. 2 is a schematic, elevation view of an illustrative embodiment of a bottom hole assembly including an illustrative embodiment of an enhanced setting tool.
Figure 3:
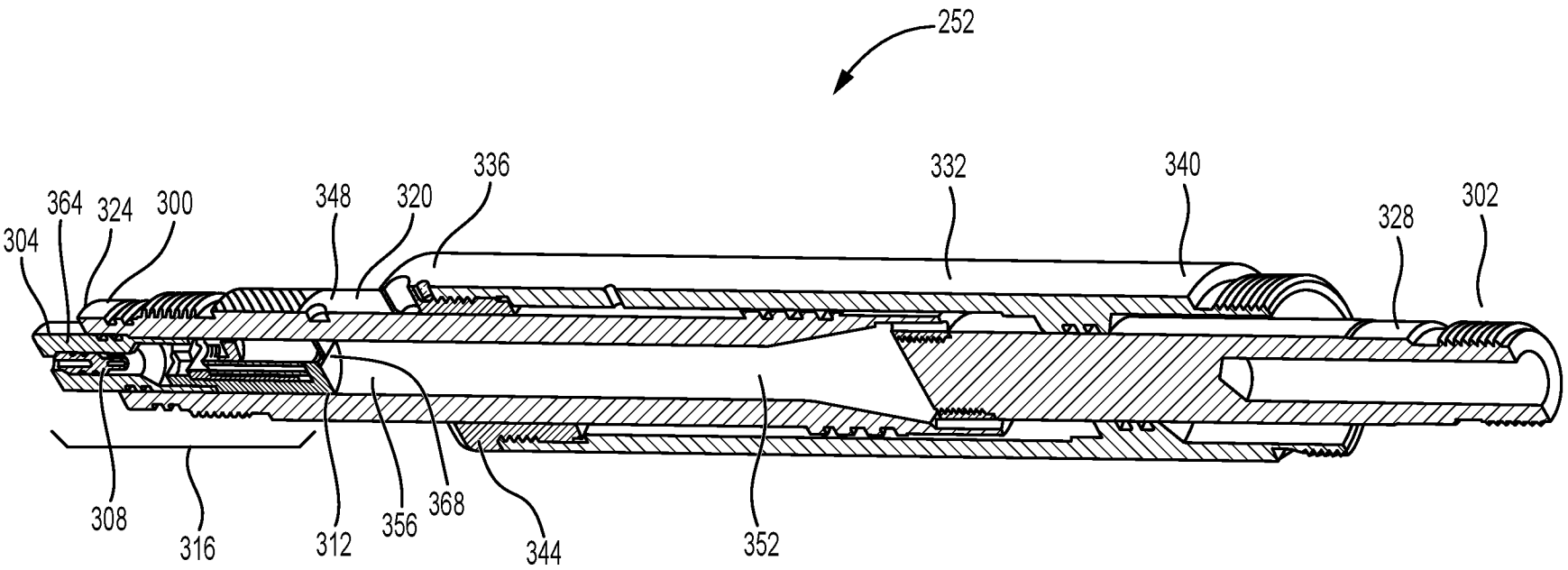
FIG. 3 is a schematic, perspective view with a portion shown in cross section of an illustrative embodiment of a fixed-volume setting tool.

With reference now primarily to FIGS. 2 and 3, an illustrative embodiment of the BHA 200 is presented which uses a fixed volume power charge initiator assembly 316 (FIG. 2). In this embodiment the BHA 200 has the same components as the BHA 100 of FIG. 1, except the firing head 140 has been eliminated. In place of the firing head, the fixed volume power charge initiator assembly 316 (FIG. 3) is located within the setting tool 254. FIG. 3. depicts a cross section of the setting tool 252 used in the BHA 200 of FIG. 2.

Referring now primarily to FIG. 2, the upper most component of the bottom hole assembly 200 as shown is the perforating gun 204 having the upper end 208 (or first end) and the lower end 212 (or second end). The perforating gun 204 is followed by the adapter 216 having the upper end 220 (or first end) and the lower end (or second end) 224. The upper end 220 of the adapter 216 couples with the lower end 212 of the perforating gun 204. A quick change 228 may follow next. The quick change 228 has an upper end 232 (or first end) and a lower end 236 (or second end). In some exemplary embodiments, the quick change 228 and the adapter 216 are not necessary and are omitted. Coupled to the quick change 228 is the setting tool 252, e.g., a gas-operated setting tool. The setting tool 252 has an upper end 256 (or first end) and a lower end 260 (or second end). The setting tool 252 is coupled to the running gear 264 (or adapter), which has an upper end 268 (or first end) and the lower end 272 (or second end). The running gear 264 is coupled to the illustrative plug 280, e.g., a fracking plug or bridge plug or other downhole plug. The plug 280 has an upper end 284 (or first end) and a lower end 288 (or second end).

The firing head 140 is not required in the BHA 200 of FIG. 2 because the ignition components, used to activate the setting tool 252, are located within the setting tool 252 (see, e.g., FIG. 3). Because of this, the illustrative setting tool 252 may be referenced as a direct-to-gun setting tool. It should be appreciated that the BHA 200 of FIG. 2 is an illustrative BHA and that other components may be used or rearranged in forming a BHA that utilizes setting tool 252 with the fixed volume power charge initiator assembly 316. For example, the quick change 228 may not be used in the BHA or the plug 280 may be replaced with a different downhole tool that is activated by gas generation by the setting tool 252.

With reference now primarily to FIG. 3, an illustrative direct-to-gun gas-powered setting tool 252, which has a fixed volume, is presented. The setting tool 252 has an upper end 300 that receives the pressure block 304 with an associated pressure bulkhead 308 and a cartridge 312 that form a seal and thereby obviate the need for an external firing head (140 in FIG. 1) or a Plug Shoot Adapter (PSA) that holds an addressable switch. As used herein, a gas "seal" refers to sufficient sealing between components to prevent or minimize gas flow between the two components when a first gas pressure is applied to the seal or two components. The pressure bulkhead 308 and cartridge 312 form a fixed volume power charge initiator assembly 316. The setting tool 252 has the upper end 300 (or first end) and a lower end 302 (or second end). An adapter, which has an upper end (or first end) and a lower end (or second end), may be applied at the upper end 300 of the setting tool 252 to couple the setting tool 252 to other components, such as an adapter 216 (FIG. 2).

In one illustrative embodiment, the setting tool 252 for use in oil wells includes a mandrel 320 having an upper end 324 (or first end) and lower end 328 (or second end) and a barrel piston 332 having an upper end 336 (or first end) and a lower end 340 (or second end). A retaining cap or ring 344 also goes around an exterior 348 of the mandrel 320 and is coupled to the upper end 336 of the barrel piston 332. For purposes of this disclosure, the retaining cap or ring 344 may be regarded as a portion of the barrel piston 332. The barrel piston 332 extends over at least a portion of the mandrel 320 when in an in-line configuration and is releasably coupled in a relative position to the mandrel 320 when in the in-line configuration. The mandrel 320 includes an interior combustion chamber 352 having an upper end 356 (or first end) proximate to the first end 324 of the mandrel 320 that is, when assembled, adjacent to the pressure block 304. The combustion chamber 352 contains a power charge (486 FIG. 6) that is not explicitly shown in this figure. The pressure block 304 has an upper end 364 (or first end) and a lower end 368 (or second end). The lower end 368 of the pressure block 304 seals or helps seal the upper end 356 of the combustion chamber 352 (see FIGS. 6 and 7), thereby defining a set, known volume into which combustion gases will be generated upon ignition of the power charge in the combustion chamber 352.

The setting tool 252 includes the pressure block 304 disposed in the mandrel 320 at the upper end 324 of the mandrel 320 that helps to seal the upper end 356 of the combustion chamber 352 along with the pressure bulkhead 308.

Figure 4:
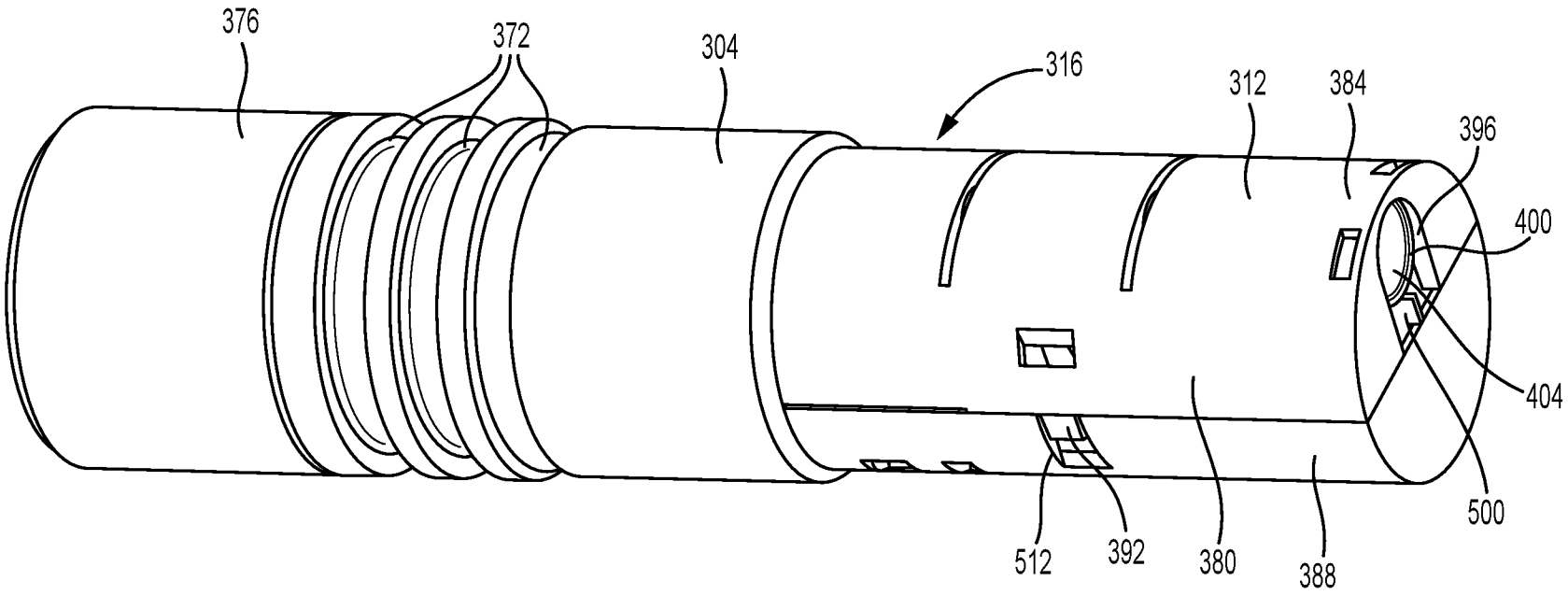
FIG. 4 is a schematic, perspective view of a fixed volume power charge initiator assembly in a pressure block according to an illustrative embodiment.

Referring now generally to FIGS. 4-9, various aspects of an illustrative embodiment of a fixed volume power charge initiator assembly 316 are presented. Referring primarily to FIG. 4, a schematic perspective view of a fixed volume power charge initiator assembly 316 coupled to a pressure block 304 is presented. The pressure block 304 is formed with seal grooves 372 formed on an exterior 376 for receiving O-rings. The fixed volume power charge initiator assembly 316 is inserted into the pressure block 304 and coupled thereto to form a pressure seal.

Figure 6:
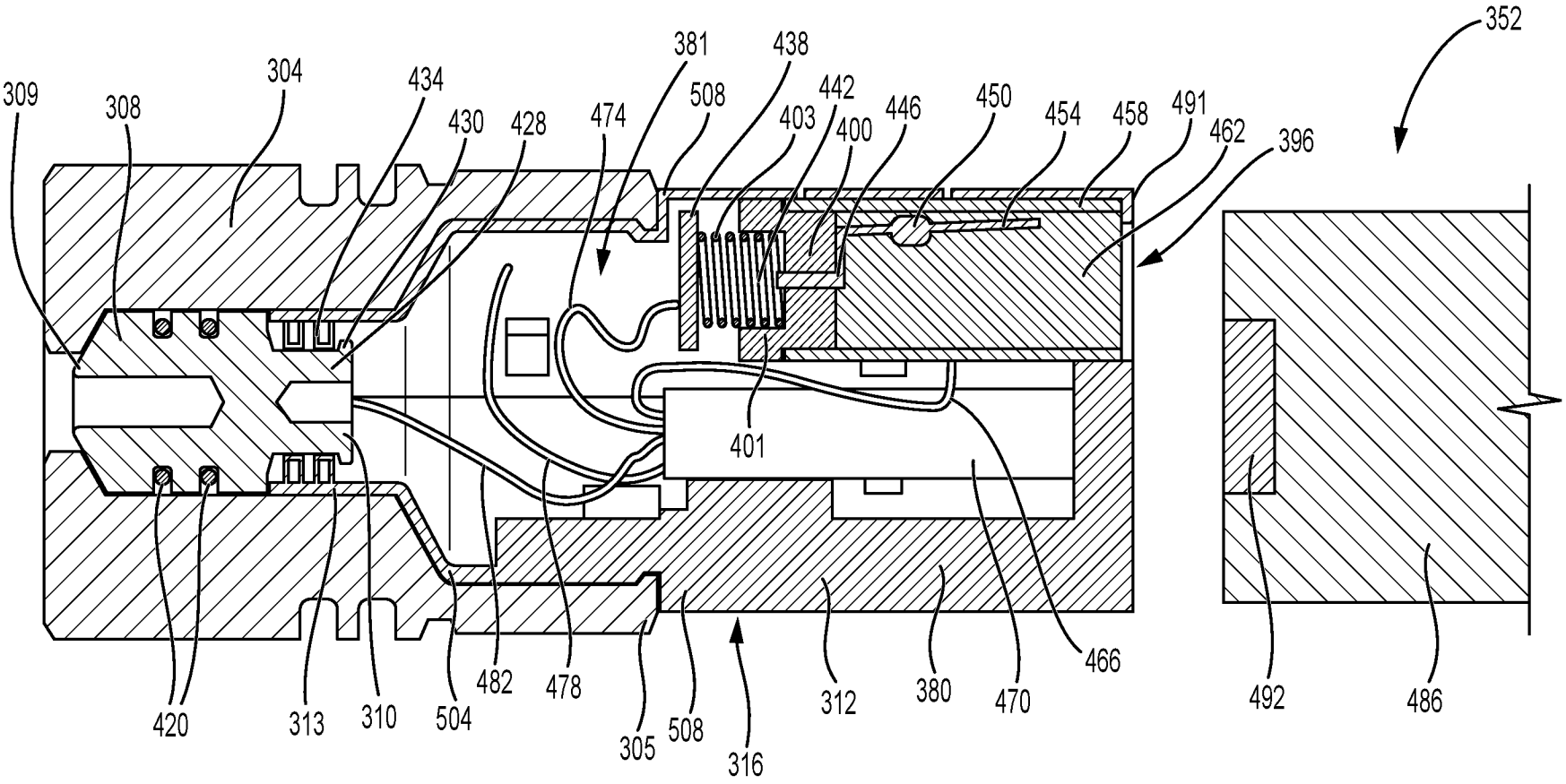
FIG. 6 is a schematic, cross-sectional view of an illustrative embodiment of a fixed-volume setting tool showing a pressure block with a fixed volume power charge initiator assembly coupled thereto.

One may see in this view that the cartridge 312 has a housing body 380 that may be a clam shell arrangement with a first side 384 and a second side 388 that are mated and that are held together by tabs 392 of the first side 384 of the housing body 380 that are fitted into slots 512 (see FIG. 9) of the second side 388 of the housing body 380. The housing body 380 may be formed with an exhaust aperture 396 through which a fireball emits during ignition to ignite a booster pellet 492 (FIG. 6) or a power charge 486 (FIG. 6). A face 404 of an igniter 400 is shown. The igniter 400 is supported by a platform 500 or support structure.

Figure 5:
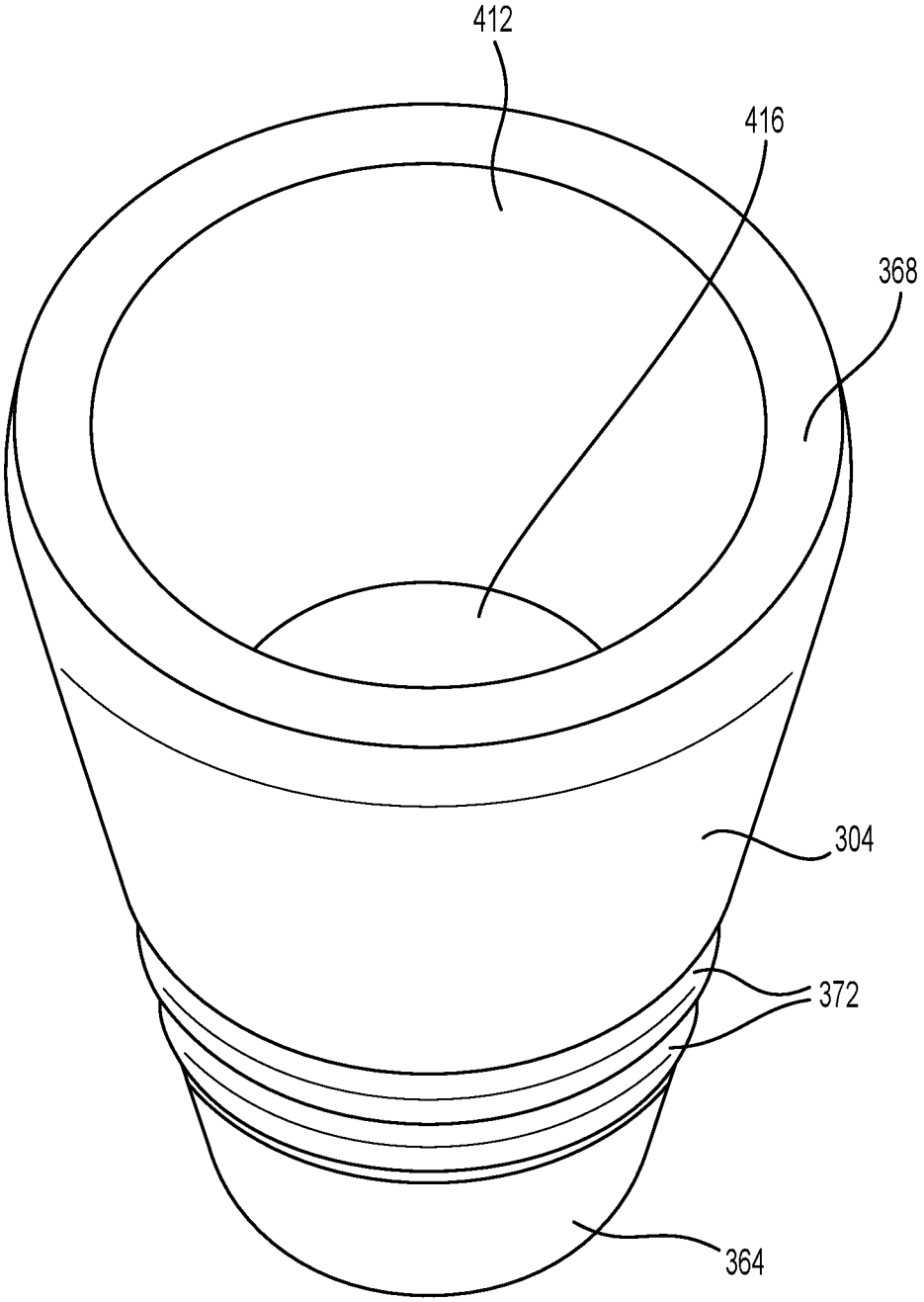
FIG. 5 is a schematic, perspective view of a pressure block according to an illustrative embodiment.

Referring now primarily to FIG. 5, a schematic, perspective top view of the illustrative pressure block 304 is presented. The second, lower end 368 of the pressure block 304 is clearly seen and one may see a configured bore 412 through the pressure block 304. The configured bore 412 has a shoulder portion 416 that receives a complementary or matching side of the first cartridge shoulder 508 (FIG. 8) on the cartridge 312. The configured bore 412 is sized and configured to mate with the cartridge 312 of the fixed volume power charge initiator assembly 316 so that once the fixed volume power charge initiator assembly 316 is inserted into the pressure block 304, a tight seal is formed between the fixed volume power charge initiator assembly 316 and the pressure block 304, by o-rings, e.g., o-rings 420 (FIG. 6). In some embodiments, the seal is formed by the seals on the pressure block (FIG. 4) and on the power charge initiator assembly (FIG. 6). As used herein "seal" in reference to the pressure block 304 and the assembly 316 means a substantial gas seal able to substantially reduce the amount of gas flowing past the seal, in this case, in the uphole direction when the power charge 486 (FIG. 6) is activated.

Figure 7:
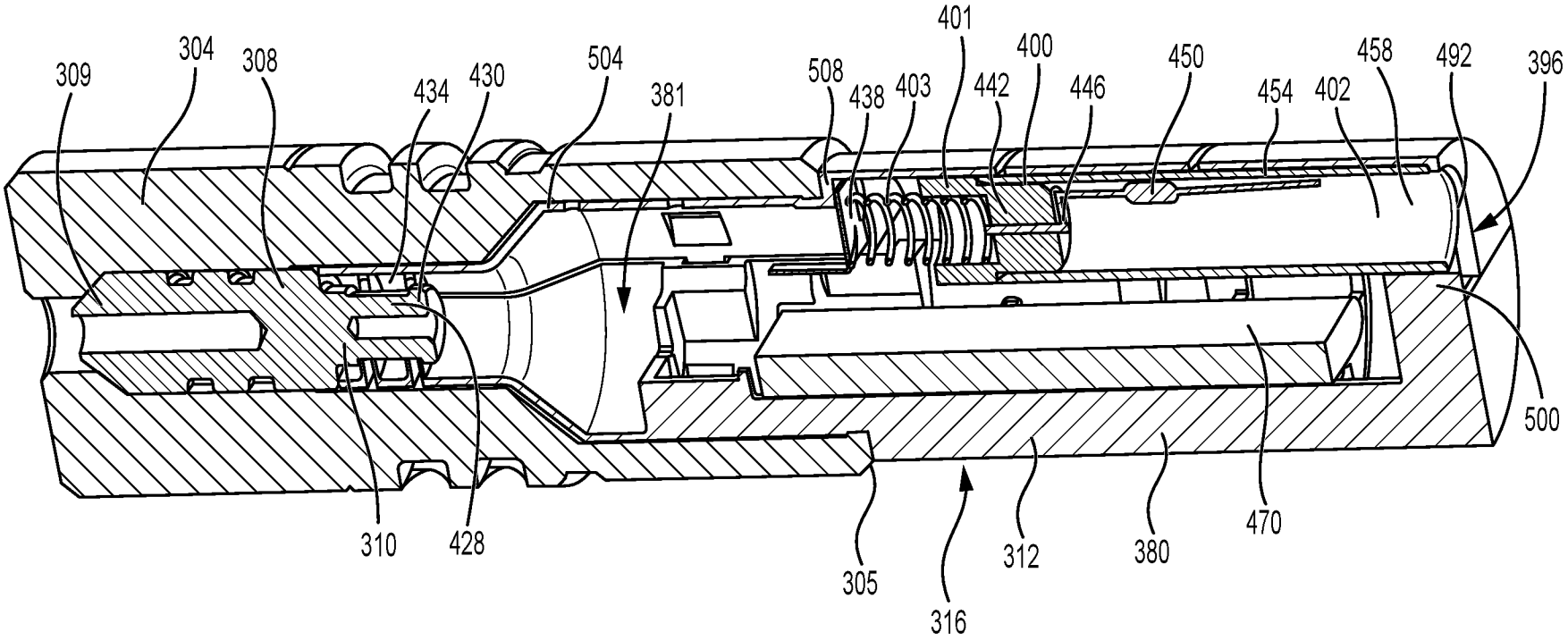
FIG. 7 is a schematic, perspective view with a portion shown in cross-section of an illustrative embodiment of a fixed volume power charge initiator assembly coupled to a pressure block.

Reference is now made primarily to FIGS. 6 and 7. In FIG. 6, a schematic, cross section of the pressure block 304, the cartridge 312, and the combustion chamber 352 is presented in an assembled position but with a number of components not shown for clarity, and in FIG. 7 a schematic, perspective cross section of a fixed volume power charge initiator assembly 316 in a pressure block 304 is presented. The fixed volume power charge initiator assembly 316 is inserted into and coupled to the pressure block 304. Seals 420, e.g. o-rings, are shown in seal grooves 424. The seals 420 seal the space between the pressure bulkhead 308 and the pressure block 304 and provide a part of the pressure seal that prevents expansion gasses from traveling in the uphole direction when the setting tool 252 is activated. The second, lower end 310 of the pressure bulkhead 308 includes a pressure-bulkhead mating portion 428, which may have ridges or shoulders 430 or other items, to mate with a cartridge mating portion 434 formed on the first end 313 of the cartridge 312, and that may have coordinated ridges or posts. An igniter 400 is disposed on an interior cavity 381 of the housing body 380. The igniter 400 may be any suitable igniter, such as a GO STYLE Igniter from Diamondback Industries. The lower end of the igniter tube 458 may abut a lip 491. The igniter 400 is supported by a plurality of ribs or a platform and at one end by platform 500.

The igniter 400 has an igniter spring 403 on a first end 401. When the igniter 400 is assembled, the spring 403 goes between an igniter button 442, which may be NYLON material or another material, and a conductive plate 438. The igniter button may be plastic, rubber, or other suitable material and serves and an insulator for electrical current. The igniter spring 403 is electrically coupled at a second end to a first lead 446 on a resistor 450. A second lead 454 of the resistor 450 is electrically coupled to an igniter tube 458, or body, which is conductive. In some embodiments, the igniter tube 458 is electrically coupled to the inner wall of the mandrel 320 of the setting tool 220 via grounding fins 576 (FIG. 10A), or bow springs. The igniter tube 458 may be, for example, stainless steel. The igniter tube 458 is filled with a combustion mix 462 that is readily ignited when sufficient power is supplied to the resistor 450.

The igniter tube 458 is coupled by a first wire 466 to a switch 470. The switch 470 may be any suitable switch available on the market. Hunting Titan Control Fire™ switch and SWM Technologies PerfStrike™ switch are two exemplary switches commonly used in the art. A switch 470 uses three electrical connections to function, which are a line in, a line out, and a ground. A second wire 474 electrically couples the switch 470 to the conductive plate 438 to provide the line out. The switch 470 may be grounded to the pressure block 304 by third wire 478. A fourth wire 482 electrically couples the pressure bulkhead 308 to the switch 470, to provide the line in.

A power charge 486 is disposed within the combustion chamber 353 (see FIG. 3) and includes a booster pellet 492, which is a material more readably ignitable than the power charge 486. When the appropriate signal is delivered through the fourth wire (line in) 432 to the switch 470, which recognizes and acts on the command to fire, a current is delivered over the second wire (line out) 474 to the conductive plate 438. From there, the current is delivered via the igniter spring 403 and the first lead 446 to the resistor 450 with its completed circuit through the second lead 454. Once sufficient energy is supplied, the combustion mix 462 ignites and fire is delivered through exhaust aperture 396 to the booster pellet 492, which in turn ignites the power charge 486. Thereby, adequate pressurized gas is delivered for use in the setting tool 252 in performing work.

FIG. 7 is analogous in most respects to FIG. 6, except the combustion mix 462 has been removed. The switch 470 is shown as a shown as a sold block. Those in the art will appreciate that the switch 470 comprises electrical components.

Figure 8:
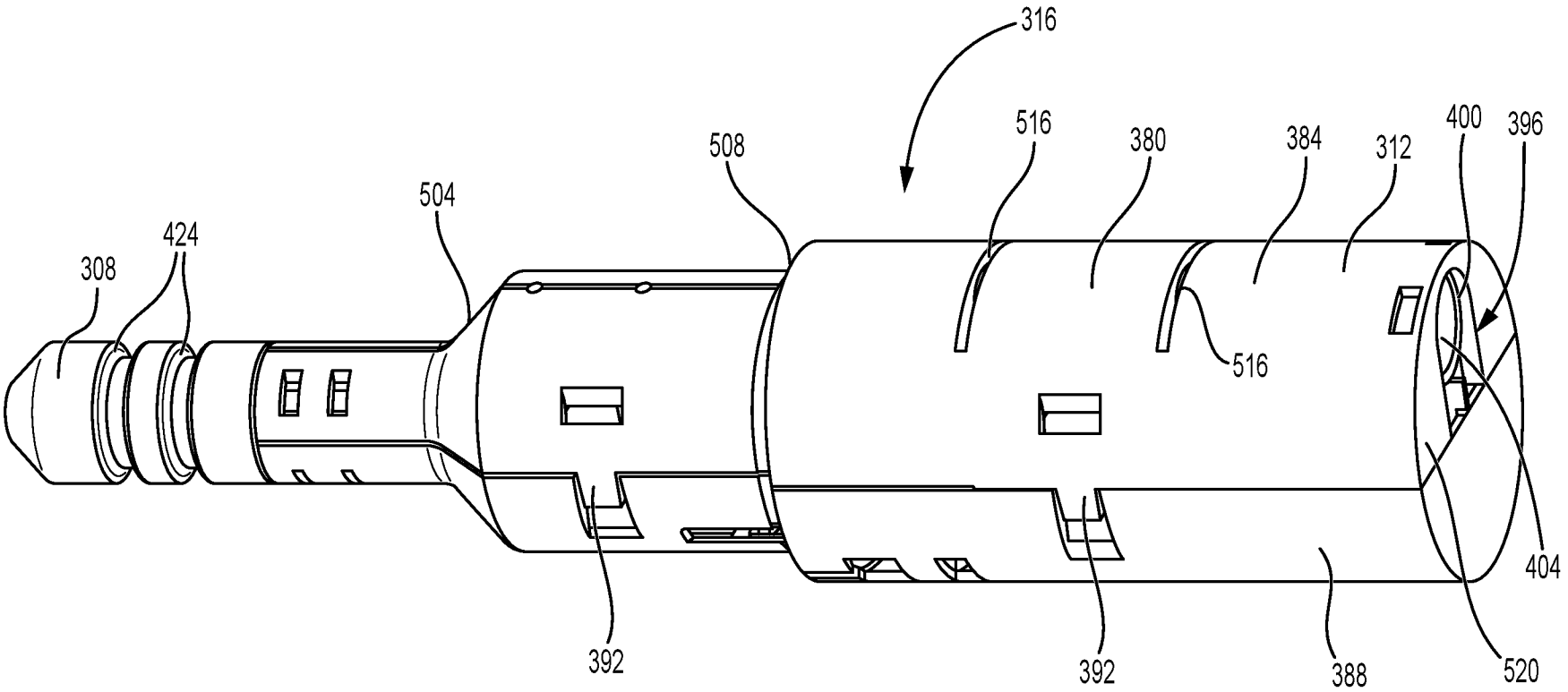
FIG. 8 is a schematic, side perspective view of a fixed volume power charge initiator assembly according to an illustrative embodiment.

Referring now primarily to FIG. 8, illustrative aspects of an exterior of the fixed volume power charge initiator assembly 316 according to an illustrative embodiment are depicted. The bulkhead 308 is located on an uphole end of the fixed volume power charge initiator assembly 316, and the seal grooves 424 are provide for insertion of the seals 420 (FIG. 6). When the fixed volume power charge initiator assembly 316 is inserted into the pressure block 304 (FIG. 6) the pressure bulkhead 308 and seals 424 form a tight seal between the fixed volume power charge initiator assembly 316 and the pressure block 304. The exterior of the fixed volume power charge initiator assembly 316 also has a first shoulder 504 and a second shoulder 508 on the cartridge 312 portion of the fixed volume power charge initiator assembly 316.

The cartridge 312 may include one or more shoulders. The embodiment of FIG. 8 includes two shoulders. The first shoulder 504 and a second shoulder 508 are configured to conform and mate with the interior of the pressure block 304 (FIG. 5) when assembled, so that the exterior wall of the cartridge 312 mates or cooperates with an interior wall of the configured bore 412 of the pressure block 304 (FIG. 5). For example, in the illustrative embodiment of FIGS. 6 and 7, it can clearly be seen that the first shoulder 504 of cartridge 312 mates with and conforms to shoulder portion 416 (see FIG. 5) of pressure block 304. Likewise, the second shoulder 508 of cartridge 312 is designed to mate and conform with a downhole edge 305 (FIG. 6) of the pressure block 304. In this manner, the connection between the cartridge 312 and the pressure block 304 is further sealed to prevent gas flow from the cartridge 312 in the uphole direction past the pressure block 304.

One or more slots 516 are also visible in FIG. 8. The slots 516 depicted in the illustrative embodiment of FIG. 8 are exemplary. The slots 516 may be of different shapes or sizes and may be located at different locations on the cartridge 312. The slots 516 may serve various purposes. For example, the slots 516 may be used to pass fasteners, such as wire ties or strapping, from the interior of the cartridge 312 to the exterior of the cartridge 312. Such wire ties or other strapping may be used to secure or fasten various components within the interior of the cartridge 312. Other standard fasteners, such as bolts, nuts, screws, etc., may also be used for this purpose. Another possible purpose of the slots 516 is to provide venting or stress relief features to the cartridge 312, which may assist in assembling the fixed volume power charge initiator assembly 316 and its various components.

Like in FIG. 4, the igniter 400 can be seen through the exhaust aperture 396 located in the downstream wall 520 of the cartridge 312. Upon activation of the igniter 400, the combustion mix 462 (FIG. 6) of the igniter 400 is ignited. The ignition of the combustion mix 462 results in a fire or explosion, which is exhausted out of exhaust aperture 396. As clearly shown in FIG. 6, the exhaust aperture 396 is in, at least partial alignment with the booster pellet 492 and the power charge 486. Therefore, the fire or explosion emitting from exhaust aperture 396 is directed toward the booster pellet 492 and the power charge 486, which in turn results in the ignition of the booster pellet 492 and the power charge 486.

Figure 9:
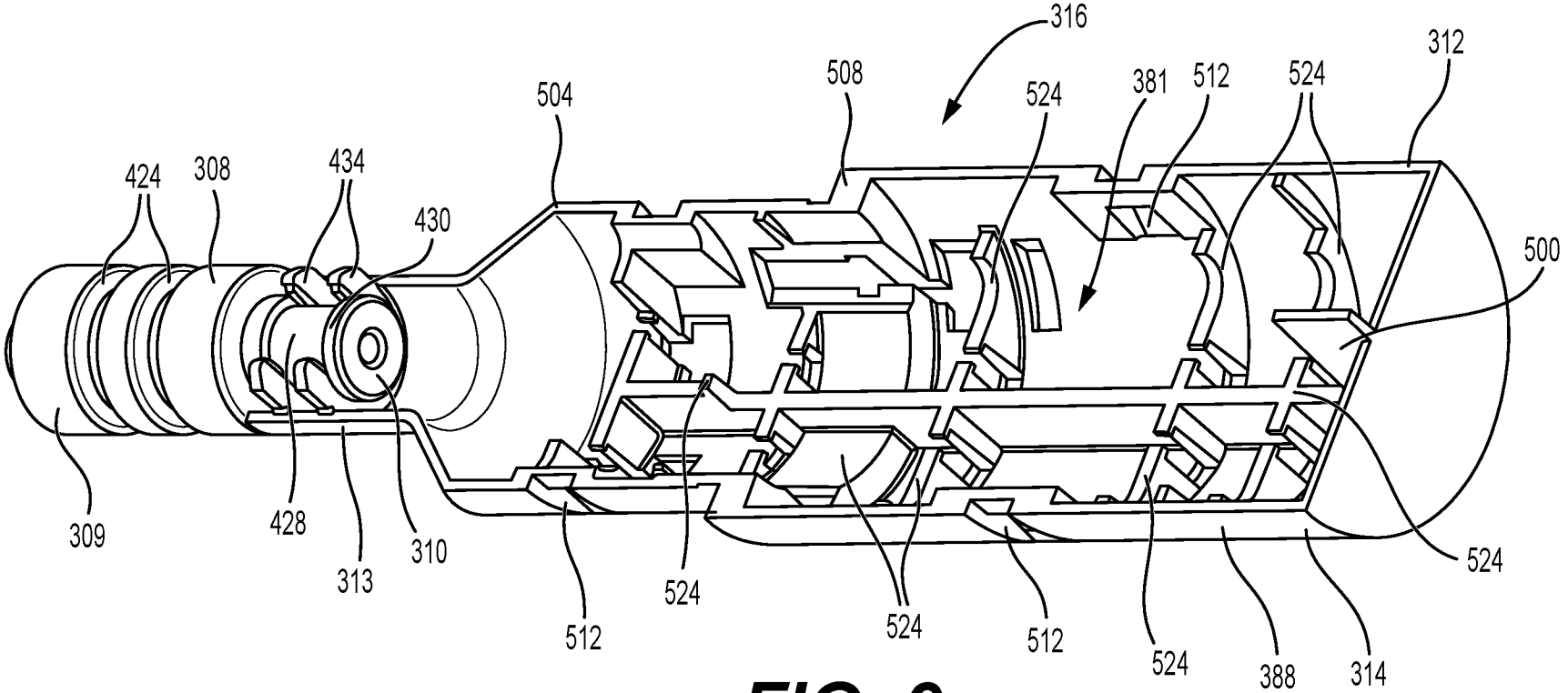
FIG. 9 is a schematic, perspective view of a side of a clam shell arrangement of a cartridge according to an illustrative embodiment.

Referring now primarily to FIG. 9, illustrative aspects of an interior of an illustrative embodiment of the fixed volume power charge initiator assembly 316 are depicted. FIG. 9 depicts an illustrative embodiment of the interior of the second side 388 of the housing body 380 of the cartridge 312 so that the interior cavity 381 of the housing body (for the second side 388) is clearly visible. It should be understood that the first side 384 of the housing body 380 may have the same or analogous features and the designation of a "first" and "second" sides of the housing body 380 is for descriptive clarity and is arbitrary. The cartridge mating portion 434 of the cartridge 312 and the pressure bulkhead mating portion 428 of the pressure bulkhead 308 can be clearly seen. The pressure bulkhead mating portion 428, in this illustrative embodiment, has ridge 430, which protrudes from the second end 310 of the pressure bulkhead 308. The cartridge mating portion 434 of the cartridge 312 is formed from tabs extending from the second side 388 of the cartridge 312 into the interior cavity 381 of cartridge 312. When the fixed volume power charge initiator assembly 316 is assembled, the pressure bulkhead 308 is attached to the cartridge 312 by inserting the pressure bulkhead mating portion 428 into the space between the tabs of the cartridge mating portion 434 or held to one side of at least one tab so that the ridge 430 of the pressure bulkhead mating portion 428 is captured by the tabs of the cartridge mating portion 434. When the first side 384 of the housing body 380 is attached to the second side 388 of the housing body 380, the pressure bulkhead 308 is trapped in place and secured. It will be appreciated that in other embodiments the pressure bulkhead 308 may be attached to the cartridge 312 by other methods, such as nuts, bolts, glues, threaded connections, etc. In other embodiments, the pressure bulkhead 308 and the cartridge 312 may be one integrated component.

Another feature of the illustrative interior of the fixed volume power charge initiator assembly 316 depicted in FIG. 9 is the support ribs 524. It should be appreciated that multiple support ribs 524 are depicted in FIG. 9, however, the particular size, location, number, shape, etc. of the support ribs 524 is only illustrative. Other embodiments may have different numbers of support ribs 524, which may be in different locations with the interior cavity 381 of the housing 380. The support ribs 524 may also serve various or multiple purposes. For example, the support ribs 524 may be sized, configured, and located to hold in place the internal components of the cartridge 312. For example, multiple support ribs 524 may be shaped to conform with the igniter tube 458 of an igniter 400 and located so that when the igniter 400 is placed upon the support ribs 524 and the first side 384 of the housing body 380 and the second side 388 of the housing body 380 are assembled, the igniter 400 is securely held in place with the face 404 of the igniter 400 directed toward the exhaust aperture 396, as described above (FIG. 4). In an analogous manner, various other support ribs 524 can be used to hold and secure the other internal components of the cartridge 312, such as the switch 470 (FIG. 7), conductor plate 438, and igniter spring 403, etc. The support ribs 524 may also serve the purpose of providing rigidity and strength to the cartridge 312. When the ribs 524 are used to mount and secure the igniter 400, they may be referred to as igniter ribs or an igniter platform. Likewise, when ribs 524 are used to mount and secure the switch 470, they may be referred to as switch ribs or a switch platform.

Figure 10A:
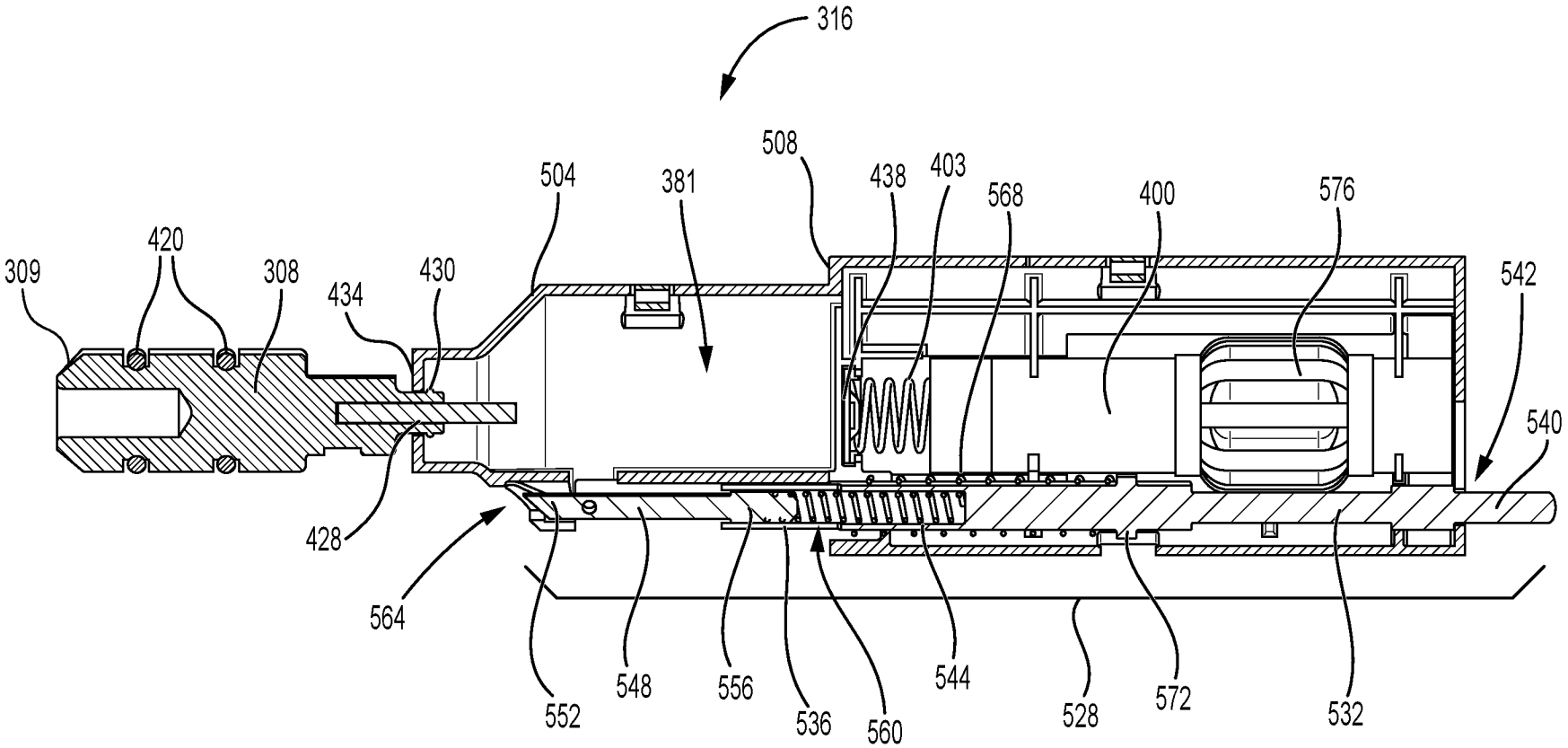
FIG. 10A is a schematic, cross-sectional view of an illustrative embodiment of a fixed-volume setting tool with a power charge detector switch in an inactivated state.
Figure 10B:
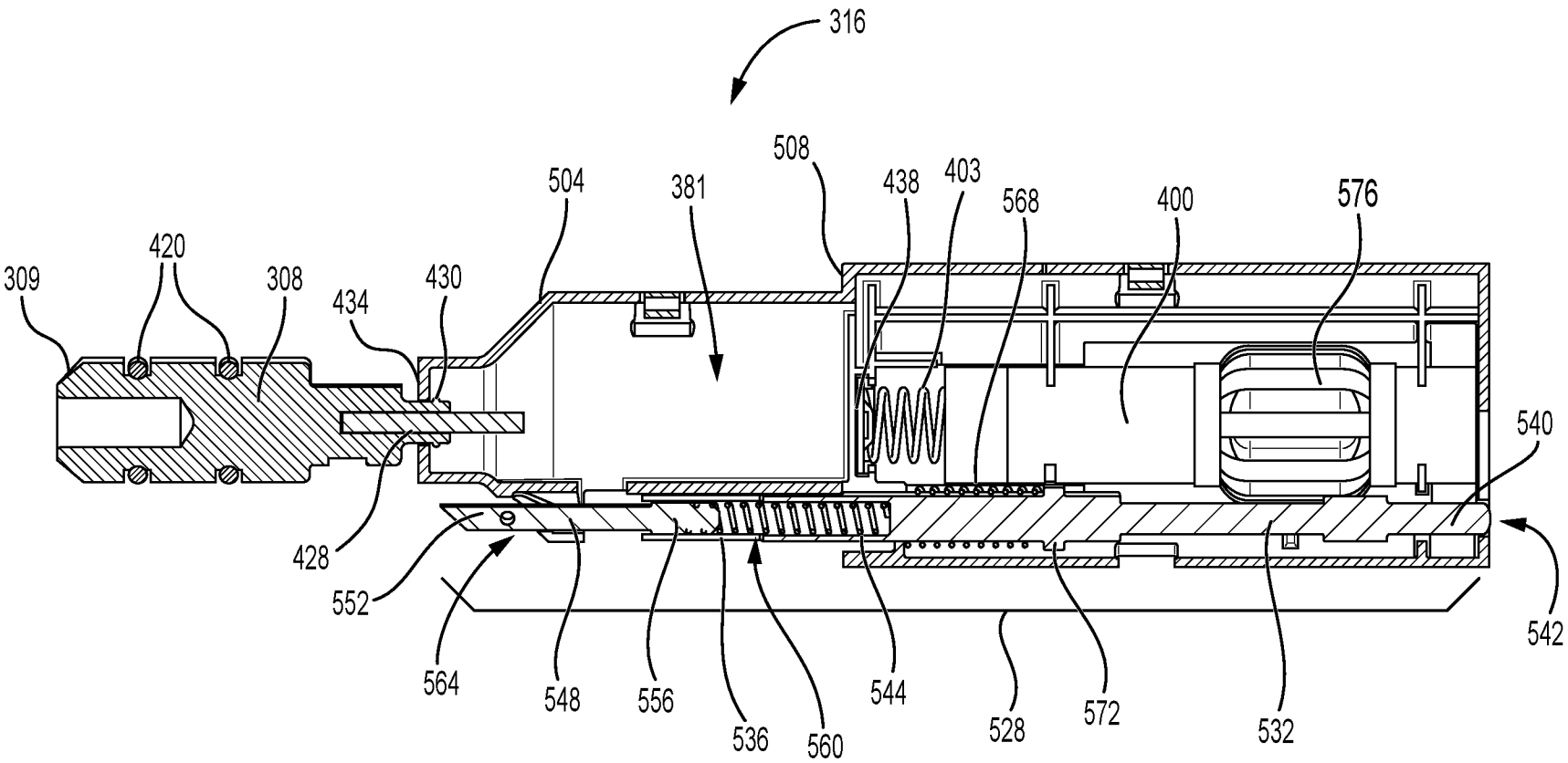
FIG. 10B is a schematic, cross-sectional view of an illustrative embodiment of a fixed-volume setting tool with a power charge detector switch in an activated state.

Now referring to FIGS. 10A and 10B, another illustrative embodiment of a fixed volume power charge initiator assembly 316 is depicted. Many of the features and components of this illustrative embodiment of the fixed volume power charge initiator assembly 316 are the same or analogous to those described in relation to the previous illustrative embodiments of fixed volume power charge initiator assembly 316 of FIGS. 3-9. However, some differences exist.

The fixed volume power charge initiator assembly 316 of FIGS. 10A and 10B has power charge detector switch 528. The purpose of power charge detector switch 528 to detect the presence of a power charge 486 (FIG. 6) in interior combustion chamber 352 of the mandrel 320 (see FIGS. 3 and 6). When assembled within the setting tool 252, the downhole face of the fixed volume power charge initiator assembly 316 abuts the uphole face of the of the power charge 486. When this happens, the power charge detector switch, namely a switch rod 532, is pushed in the uphole direction (left in the orientation shown) by interaction with the power charge 486. If a power charge 486 has not been inserted into the interior combustion chamber 352, then the power charge detector switch 528 will not be pushed in because there is no power charge 486 present to push in the power charge detector switch 528.

The power charge detector switch 528 has the switch rod 532 that has a first end 536 and a second end 540, a contact spring 544, and a contact rod 548 that has a first end 552 and a second end 556. The second end 540 of the switch rod 532 extends through the switch rod aperture 542 from the downhole side of the cartridge 312. The first end 536 of the switch rod 532 is formed to receive the contact spring 544 in a contact spring cavity 560 of the first end 536 of the switch rod 532. The second end 556 of the contact rod 548 is designed to mate with and engage the other end of the contact spring 544. The first end 552 of contact rod 548 is aligned with contact aperture 564.

FIG. 10A depicts the power charge detector switch 528 in an inactivated state, i.e. no power charge 486 detected. FIG. 10B depicts the power charge detector switch 528 in an activated state. In the inactivated state, the biasing spring 544 completes a circuit signifying the presence of the power charge 486.

The first end 536 of the switch rod 532 is shaped to receive the biasing spring 568 over the exterior of the switch rod 532. When assembled the biasing spring 568 interacts with the interior features of the cartridge 312 and the spring tabs 572 of the switch rod 532. This biasing force causes the switch rod 532, contact spring 544, and contact rod 548 assembly to be biased toward the downhole direction (to the right as shown). In this state, the second end 540 of the switch rod 532 extends through switch aperture 542 and the first end 552 of the contact rod 548 does not extend through contact aperture 564 as shown in FIG. 10A. When the power charge detector switch 528 is in an activated state, as shown in FIG. 10B, the second end 540 of the switch rod 532 does not extend through or only partially extends through the switch aperture 542 and the first end 552 of the contact rod 548 extends through contact aperture 564. When a force greater than a biasing force of the biasing spring 568 is applied to the second end 540 of the switch rod 532 in the uphole direction (to the left as shown), the power charge detector switch 528 is moved from an inactivated state to an activated state thereby completing a circuit.

A portion of the power charge detector switch 528 forms part of the electrical circuit used to activate the igniter 400. As described in relation to the illustrative embodiments of FIGS. 6-9, electrical current to activate the igniter 400 is supplied to the igniter 400 from the conductive plate 438 to the igniter spring 403 to the igniter 400. In the embodiments of FIG. 6-9, the electrical circuit of the igniter 400 is completed by eventually grounding the circuit to a grounded metal body of the assembly. In the embodiment of FIGS. 10A and 10B, the circuit through the igniter 400 is grounded through the power charge detector switch 528. The igniter 400 has grounding fins 576 extending from the body of the igniter 400. The grounding fins 576 are electrically connected to the ignition circuit coming out of the igniter 400. The grounding fins 576 are electrically coupled to the contact spring 544 of the power charge detector switch 528. The contact rod 548, being made from electrical conducting material, is in electrical contact with the contact spring 544. Therefore, the combination of the grounding fins 576, contact spring 544, and contact spring 544 continue the electrical ignition current coming out of the igniter 400.

When the fixed volume power charge initiator assembly 316 is assembled within the setting tool 252 and power charge 486 is omitted, the power charge detector switch 528 will be in an inactivated state and the first end 552 of the contact rod 548 will not extend through the contact aperture 564. Since the first end 552 of the contact rod 548 does not extend through the contact aperture 564, the contact rod 548 will not be in contact with a component that completes the electrical ignition circuit of the igniter 400. On the other hand, when the fixed volume power charge initiator assembly 316 is assembled within the setting tool 252 and the power charge 486 is included, the power charge detector switch 528 will be in an activated state and the first end 552 of the contact rod 548 will extend through contact aperture 564. In this case, the first end 552 of the contact rod 548 will contact the pressure block 304 (see FIG. 6). Since the pressure block 304 is a grounded component, the contact between the first end 552 of the contact rod 548 with the pressure block 304 completes the electrical circuit through the igniter 400. Components of the power charge detector switch 528 are insulated or made from non-conductive material as needed to prevent short circuiting the ignition circuit.

Figure 12:
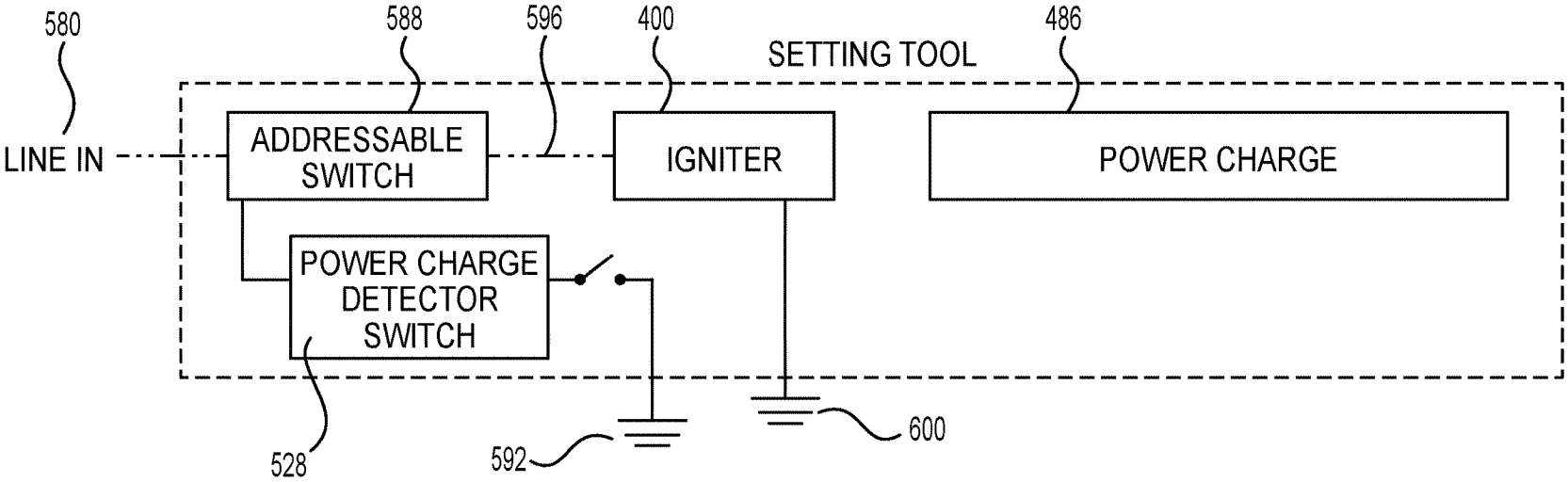
FIG. 12 is a schematic, electrical circuit diagram of an illustrative embodiment of a fixed volume power charge initiator assembly.

After assembly of the components of the setting tool 252 and BHA 200 and prior to running the BHA 200 downhole, an operator can verify the presence or absence of a power charge 486 using the illustrative embodiment of FIGS. 10A and 10B. While application of a large amount of electrical current would result in unwanted activation of the igniter 400, a small amount of electrical current can be applied to an addressable switch such as the switch 470 (FIG. 7) or addressable switch 588 (FIG. 12) within the ignition circuit of the igniter 400 to take inventory—to see if the switch is present. In some illustrative embodiments, the power charge detector switch 528 is included in an electrical circuit as shown in FIG. 12. In these embodiments the power charge detector switch 528 is located in the grounding circuit for an addressable switch 588. In this configuration, an operator can readily "take inventory" of the switch 588. A small amount of current is applied to the line in 580 of the addressable switch 588 to verify the presence the addressable switch 588 and electrical connection to the addressable switch 588.

When applying the small amount of electrical charge, if a power charge 486 is present, then the power charge detector switch 528 will be in an activated state and the addressable switch 588 grounding portion of the electrical circuit will be complete by the contact between the pressure block 304 and the contact rod 548. In this case, the verification of circuit continuity verifies the presence of an addressable switch 588, which in turn verifies the presence of a power charge 486. If a power charge 486 is not present then the power charge detector switch 528 is in the inactivated state and the circuit is not completed because the pressure block 304 and the contact rod 548 are not in electrical contact with each other.

In some illustrative embodiments, when the power charge detector switch 528 is in an inactivated state, the components of the power charge detector switch 528 do not make a grounded connection for an igniter electrical circuit or an addressable switch electrical circuit and, when the power charge detector switch 528 is in an activated state, at least one component of the power charge detector 528 switch makes a grounded connection for the igniter electrical circuit or the addressable switch electrical circuit by contacting a grounded component.

In other embodiments, the power charge detector switch 528 can be included in other electrical circuits of the BHA 200 and used in an analogous manner to detect the presence or absence of the power charge 486.

Figure 11:
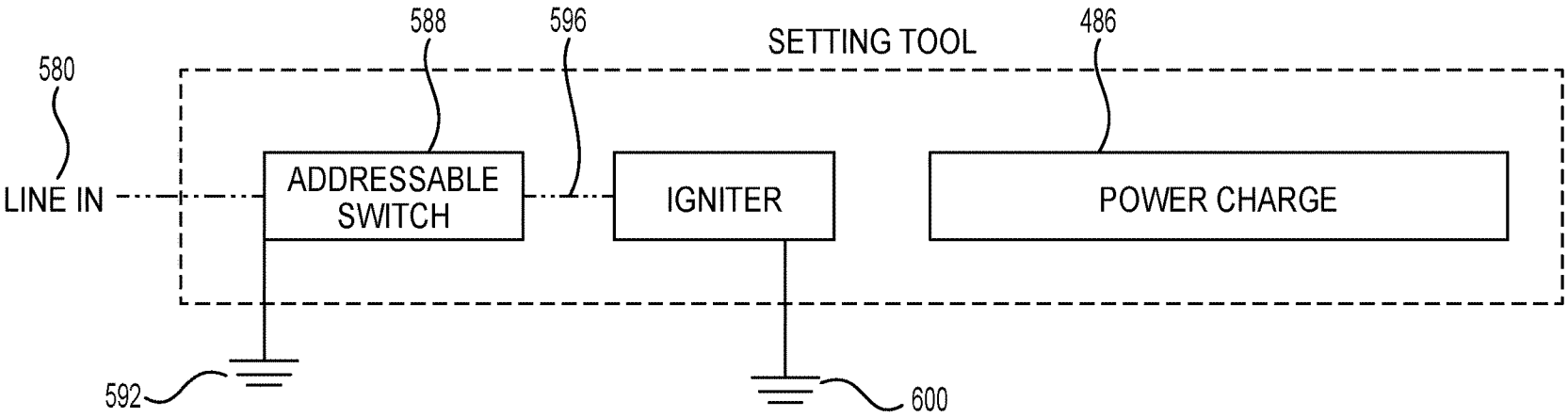
FIG. 11 is a schematic, electrical circuit diagram of an illustrative embodiment of a fixed volume power charge initiator assembly.

Referring now primarily to FIGS. 11 and 12, two illustrative circuits of illustrative fixed volume power charge initiator assemblies 316 are shown. In the illustrative embodiment of FIG. 11, power is supplied by the line in 580 which supplies power to the addressable switch 588. The addressable switch is grounded at ground 592. Current out of the addressable switch is directed to the igniter 400 by the wire 592. The circuit is completed by the ground 600. In this embodiment, the power charge detector switch 528 is not used. However, in other embodiments the power charge detector switch 528 could be electrically included within the circuit between the line in 580 and the ground 600 of the addressable switch 588. In the illustrative embodiment of FIG. 12, power is supplied by the line in 580 which supplies power to the addressable switch 588. In this embodiment, the addressable switch 588 is not directly grounded to the ground 592. Instead, the power charge detector switch 528 is inserted into the circuit between the addressable switch 588 and the ground 592. Therefore, an operator can detect the presence or absence of a power charge 486 by determining if there is electrical continuity to the addressable switch ground pathway. The addressable switch 588 cannot "talk" to the surface if the addressable switch 588 is not grounded Therefore, when the operator takes inventory, the inventory will be short one addressable switch 588 for each addressable switch 588 that is not grounded.

In addition to the examples given, many other examples may be provided. Additional examples follow.

Example 1. A gas-operated fixed-volume setting tool for use in oil wells comprising:

a mandrel having an upper portion and a lower portion;

a barrel piston having a first end and a second end, and wherein the barrel piston extends over at least a portion of the mandrel when in an in-line configuration and releasably coupled in a relative position to the mandrel when in the in-line configuration;

wherein the mandrel has a first end on the upper portion and a second end on the lower portion;

wherein the mandrel includes an interior combustion chamber having a first end proximate to the first end of the mandrel and a second end proximate to the second end of the mandrel;

a pressure block disposed in the mandrel at the first end of the mandrel and sealing the first end of the interior combustion chamber;

a pressure bulkhead coupled to the pressure block and forming a seal therewith; and a cartridge coupled to the pressure bulkhead;

wherein the pressure block, the pressure bulkhead, and the cartridge form a seal to the combustion chamber to at least a first threshold pressure on the first end of the combustion chamber and thereby define a fixed volume; and wherein the cartridge comprises:

a housing body having a first, upper end and a second, lower end, a cartridge mating portion formed on the first, upper end of the housing body that mates with a pressure-bulkhead mating portion, an interior cavity formed within the housing body, a switch-holding ribs or switch platform for receiving and holding a switch, and igniter holding ribs or igniter platform for receiving and holding an igniter.

Example 2. The gas-operated fixed-volume setting tool of Example 1, wherein the housing body is formed with an exhaust aperture on second, lower end.

Example 3. The gas-operated fixed-volume setting tool of Examples 1 or 2, further comprising a switch coupled to the switch-holding ribs or switch platform.

Example 4. The gas-operated fixed-volume setting tool of Examples 1, 2, or 3, further comprising an igniter coupled to the igniter holding ribs or igniter platform.

Example 5. A fixed volume power charge initiator assembly for use as an aspect of a gas-power setting tool, the fixed volume power charge initiator comprising:

a pressure bulkhead having a first, upper end and a second, lower end, and formed with a configured bore;

wherein the second, lower end of the pressure bulkhead is formed with a first mating member;

a cartridge having a first, upper end and a second, lower end, wherein the first, upper end of the cartridge couples to the first mating member of the pressure bulkhead;

wherein the cartridge comprises:

a housing body having a first, upper end and a second, lower end, a cartridge mating portion formed on the first, upper end of the housing body, an interior cavity formed within the housing body, a switch-holding ribs or switch platform for receiving and holding a switch, and igniter holding ribs or igniter platform for receiving and holding an igniter.

Example 6. The fixed volume power charge initiator assembly of Example 5, wherein the cartridge further comprises an igniter wall having conductive plate, wherein the igniter wall is positioned to be proximate to a first end of an igniter when the igniter is installed.

Example 7. The fixed volume power charge initiator assembly of Examples 5 or 6, wherein the housing body is formed with an exhaust aperture proximate the second, lower end of the housing body.

Example 8. The fixed volume power charge initiator assembly of Examples 5-7, further comprising:

an igniter coupled to the igniter holding ribs or the igniter platform, wherein the igniter comprises a tube having a combustion mix in an interior, a resistor within the tube having a first lead and a second lead, a conductive ignition spring coupled to the first lead and extending at a first, upper end of the igniter, and wherein the second lead is coupled to the tube.

Example 9. The fixed volume power charge initiator assembly of Examples 5-8, further comprising a switch coupled to the switch-holding ribs or switch platform.

According to one aspect of the disclosure, an igniter and a switch are moved into the setting tool itself. According to an additional aspect of the disclosure, the setting tool is formed as two components that snap fit together with the switch and they ignite or charge within and interior cavity.

With the illustrative embodiments presented, a plug shoot adapter (PSA) may be eliminated. The switch is in the setting tool. At the same time, a fixed volume is maintained which has potential advantages as well.

Example 10. A method of fracturing a well comprising providing a perforation gun; providing the gas-operated fixed volume setting tool of Example 1; and coupling the gas-operated fixed volume setting tool to the perforation gun without a separate ignitor or firing head therebetween.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A gas-operated fixed-volume setting tool for use in oil wells comprising:

a mandrel having a first end and a second end;

a barrel piston having a first end and a second end, and wherein the barrel piston extends over at least a portion of the mandrel when in an in-line configuration and is releasably coupled to the mandrel when in the in-line configuration;

wherein the mandrel includes an interior combustion chamber having a first end proximate to the first end of the mandrel and a second end proximate to the second end of the mandrel;

a pressure block disposed in the mandrel at the first end of the mandrel;

a pressure bulkhead coupled to the pressure block and forming a seal therewith; and a cartridge coupled to the pressure bulkhead;

an igniter having a first end and a second end;

wherein the pressure block, the pressure bulkhead, and the cartridge form a seal to the combustion chamber to at least a first threshold pressure on the first end of the combustion chamber and thereby define a fixed combustion chamber volume; and wherein the cartridge comprises:

a housing body having a first end and a second end, a cartridge mating portion formed on the first end of the housing body that mates with the pressure bulkhead, and an interior cavity formed within the housing body; and wherein, the igniter is at least partially disposed within the interior cavity of the cartridge.

2. The gas-operated fixed-volume setting tool of claim 1, further comprising a switch for activating the igniter, wherein the switch is disposed within the interior cavity of the cartridge.

3. The gas-operated fixed-volume setting tool of claim 2, wherein the cartridge further comprises switch ribs or a switch platform disposed within the interior cavity of the cartridge and wherein, the switch is mounted to the switch ribs or switch platform.

4. The gas-operated fixed-volume setting tool of claim 1, wherein the cartridge further comprises igniter ribs or an igniter platform disposed within the interior cavity of the cartridge and wherein, the igniter is mounted to the igniter ribs or igniter platform.

5. The gas-operated fixed-volume setting tool of claim 1, further comprising a switch for activating the igniter, wherein the switch is disposed within the interior cavity of the cartridge;

wherein the cartridge further comprises igniter ribs or an igniter platform disposed within the interior cavity of the cartridge and wherein, the igniter is mounted to the igniter ribs or igniter platform; and wherein the cartridge further comprises switch ribs or a switch platform disposed within the interior cavity of the cartridge and wherein, the switch is mounted to the switch ribs or switch platform.

6. A fixed volume power charge initiator assembly for use as an aspect of a gas-power setting tool, the fixed volume power charge initiator comprising:

a pressure bulkhead having a first end and a second end;

wherein the pressure bulkhead is formed with a pressure bulkhead mating portion;

a cartridge having a first end and a second end;

wherein the cartridge comprises:

a housing body having a first end and a second end, a cartridge mating portion formed on the first end of the housing body, and an interior cavity formed within the housing body, wherein the pressure bulkhead mating portion of the pressure bulkhead is sized and configured to mate with the cartridge mating portion of the cartridge;

a switch for activating the igniter, wherein the switch is disposed within the interior cavity of the cartridge;

wherein the cartridge further comprises switch ribs or a switch platform disposed within the interior cavity of the cartridge and wherein the switch is mounted to the switch ribs or switch platform;

an igniter, having a first end and a second end; and wherein the igniter is coupled to the cartridge and at least partially disposed within the interior cavity of the cartridge.

7. The fixed volume power charge initiator assembly claim 6, wherein the cartridge further comprises igniter ribs or an igniter platform disposed within the interior cavity of the cartridge and wherein, the igniter is mounted to the igniter ribs or igniter platform.

8. A fixed volume power charge initiator assembly for use as an aspect of a gas-power setting tool, the fixed volume power charge initiator comprising:

a pressure bulkhead having a first end and a second end;

a cartridge having a first end and a second end;

wherein the cartridge comprises:

a housing body having a first end and a second end, and an interior cavity formed within the housing body;

wherein the pressure bulkhead is coupled to first end of the cartridge and the pressure bulkhead is at least partially disposed within the interior cavity of the housing;

an igniter, having a first end and a second end;

wherein the igniter is coupled to the cartridge and at least partially disposed within the interior cavity of the cartridge;

a pressure block having a bore;

wherein an interior wall of the bore is sized and configured to mate with an exterior wall of the cartridge;

wherein the first end of the cartridge is disposed within the bore of the pressure block;

a power charge detector switch at least partially disposed within the interior cavity of the cartridge;

wherein, when the power charge detector switch is in an inactivated state, the components of the power charge detector switch do not make a grounded connection for an igniter electrical circuit or an addressable switch electrical circuit; and wherein, when the power charge detector switch is in an activated state, at least one component of the power charge detector switch makes a grounded connection for the igniter electrical circuit or the addressable switch electrical circuit by contacting a grounded component.

9. The fixed volume power charge initiator assembly of claim 8, further comprising a switch for activating the igniter; and wherein, the switch is disposed within the interior cavity of the cartridge.

10. The fixed volume power charge initiator assembly claim 8, wherein, the housing body is formed with an exhaust aperture on the second end; and wherein, the second end of the igniter is aligned with the exhaust aperture.

11. The fixed volume power charge initiator assembly claim 8, wherein, the cartridge further comprises igniter ribs or an igniter platform disposed within the interior cavity of the cartridge; and wherein, the igniter is mounted to the igniter ribs or igniter platform.

12. The fixed volume power charge initiator assembly claim 8, wherein, the cartridge further comprises switch ribs or a switch platform disposed within the interior cavity of the cartridge; and wherein, the switch is mounted to the switch ribs or switch platform.

13. The fixed volume power charge initiator assembly of claim 8, wherein, the grounded component is the pressure block.

14. The fixed volume power charge initiator assembly of claim 8, wherein the power charge detector switch further comprises:

at least one rod, and a biasing spring;

wherein, the biasing spring is coupled to the at least one rod; and wherein, the biasing spring applies a biasing force to the at least one rod so that the power charge detector switch is in an inactivated state unless a force overcomes the biasing force of the biasing spring.

15. The fixed volume power charge initiator assembly of claim 14, wherein, the at least one rod comprises a switch rod and a contact rod;

wherein, the switch rod and the contact rod are coupled to the biasing spring; and wherein, the contact rod makes electrical contact with the ground component when the power charge detector switch is in an activated state.

16. The fixed volume power charge initiator assembly of claim 8, wherein the power charge detector switch is electrically coupled to the igniter.

17. The fixed volume power charge initiator assembly of claim 8, further comprising a switch for activating the igniter;

wherein, the switch is disposed within the interior cavity of the cartridge;

wherein, the housing body is formed with an exhaust aperture on the second end;

wherein, the second end of the igniter is aligned with the exhaust aperture;

wherein, the cartridge further comprises igniter ribs or an igniter platform disposed within the interior cavity of the cartridge;

wherein, the igniter is mounted to the igniter ribs or igniter platform;

wherein, the cartridge further comprises switch ribs or a switch platform disposed within the interior cavity of the cartridge;

wherein, a switch is mounted to the switch ribs or switch platform;

wherein, the grounded component is the pressure block;

wherein, the power charge detector switch further comprises:

at least one rod, and a biasing spring;

wherein, the biasing spring is coupled to the at least one rod;

wherein, the biasing spring applies a biasing force to the at least one rod so that the power charge detector switch is in an inactivated state unless a force overcomes the biasing force of the biasing spring;

wherein, the at least one rod comprises a switch rod and a contact rod;

wherein, the switch rod and the contact rod are coupled to the biasing spring;

wherein, the contact rod makes electrical contact with the ground component when the power charge detector switch is in an activated state; and wherein, the power charge detector switch is electrically coupled to the igniter.

* * * * *